US008384621B2

(12) United States Patent
Origuchi et al.

(10) Patent No.: US 8,384,621 B2
(45) Date of Patent: Feb. 26, 2013

(54) PLASMA DISPLAY DEVICE AND METHOD FOR DRIVING PLASMA DISPLAY PANEL

(75) Inventors: Takahiko Origuchi, Osaka (JP); Hidehiko Shoji, Osaka (JP); Toshiyuki Maeda, Hyogo (JP)

(73) Assignee: Panasonic Corporation, Osaka (JP)

( * ) Notice: Subject to any disclaimer, the term of this patent is extended or adjusted under 35 U.S.C. 154(b) by 1004 days.

(21) Appl. No.: 12/092,216

(22) PCT Filed: Aug. 3, 2007

(86) PCT No.: PCT/JP2007/065224

§ 371 (c)(1),
(2), (4) Date: Apr. 30, 2008

(87) PCT Pub. No.: WO2008/018370

PCT Pub. Date: Feb. 14, 2008

(65) Prior Publication Data

US 2009/0122042 A1 May 14, 2009

(30) Foreign Application Priority Data

Aug. 10, 2006 (JP) ..... 2006-218045

(51) Int. Cl.
*G09G 3/28* (2006.01)

(52) U.S. Cl. ..... 345/60

(58) Field of Classification Search ..... 345/60–72
See application file for complete search history.

(56) References Cited

U.S. PATENT DOCUMENTS

| | | | | |
|---|---|---|---|---|
| 2004/0021656 | A1* | 2/2004 | Kang et al. | 345/204 |
| 2005/0264230 | A1 | 12/2005 | Kim et al. | |
| 2009/0167642 | A1 | 7/2009 | Kim et al. | |

FOREIGN PATENT DOCUMENTS

| | | |
|---|---|---|
| JP | 2000-242224 | 9/2000 |
| JP | 2005-196193 | 7/2005 |
| JP | 2006-53564 | 2/2006 |
| JP | 2006-235598 | 9/2006 |
| KR | 2003-0088536 | 11/2003 |
| KR | 10-2005-0071201 | 7/2005 |
| WO | 2006/013658 | 2/2006 |

OTHER PUBLICATIONS

International Search Report issued Sep. 4, 2007 in International (PCT) Application No. PCT/JP2007/065224.

* cited by examiner

*Primary Examiner* — Michael Pervan
(74) *Attorney, Agent, or Firm* — Wenderoth, Lind & Ponack, L.L.P.

(57) ABSTRACT

One field period includes a plurality of subfields each having (i) an initialization period in which a gradually descending sloping waveform voltage is applied to a scan electrode, (ii) a writing period in which a negative scan pulse voltage is applied to the scan electrode, and (iii) a sustain period. A sloping waveform voltage is generated by switching a minimum voltage in the sloping waveform voltage between a first voltage and a second voltage that has a lower voltage value than that of the first voltage. A number of subfields, in which an initialization is carried out by the sloping waveform voltage having the minimum voltage as the second voltage, is increased when a temperature of a plasma display panel is determined to be low as compared with when the temperature is determined to be not low.

6 Claims, 12 Drawing Sheets

PLASMA DISPLAY DEVICE AND METHOD FOR DRIVING PLASMA DISPLAY PANEL

TECHNICAL FIELD

The present invention relates to a plasma display device used in a wall-mounted television and a large-size monitor and to a method for driving a plasma display panel.

BACKGROUND ART

An AC surface discharge panel as a representative plasma display panel (hereinafter, abbreviated as a "panel") includes a front panel and a rear panel disposed facing each other and a large number of discharge cells between the front panel and the rear panel. The front panel has a plurality of display electrode pairs each including a pair of scan electrode and sustain electrode formed in parallel to each other on a front glass substrate thereof. A dielectric layer and a protective layer are formed so as to cover the display electrode pairs. The rear panel has a plurality of data electrodes formed in parallel to each other on a rear glass substrate thereof. A dielectric layer is formed so as to cover the data electrodes, and a plurality of barrier ribs are formed in parallel to the data electrodes further on the dielectric layer. On the surface of the dielectric layer and the side surface of the barrier ribs, a phosphor layer is formed. The front panel and the rear panel are disposed facing each other so that the display electrode pairs three-dimensionally intersect with the data electrodes, and the front panel and the rear panel are sealed with each other. In discharge space inside thereof, a discharge gas including, for example, 5% xenon in a partial pressure ratio is filled. Herein, a discharge cell is formed in a part where the display electrode pair and the data electrode face each other. In a panel having such a configuration, an ultraviolet ray is emitted by a gas discharge in each discharge cell. By using this ultraviolet ray, phosphor of each color, i.e., red, green and blue, is excited to emit light so as to carry out a color display.

As a method for driving the panel, a subfield method is generally used. The subfield method includes dividing one field period into a plurality of subfields and displaying a gradation by driving a combination of the subfields to emit light.

Each subfield includes an initialization period, a writing period and a sustain period. In the initialization period, an initialization discharge is generated so as to form a wall charge necessary for the following writing operation on each electrode. The initialization operation includes an initialization operation for generating an initialization discharge in all discharge cells (hereinafter, abbreviated as an "all-cell initialization operation") and an initialization operation for generating an initialization discharge in a discharge cell in which a sustain discharge has been carried out (hereinafter, abbreviated as a "selective initialization operation").

In the writing period, a writing pulse voltage is selectively applied to a discharge cell to be displayed so as to generate a writing discharge and to form a wall charge (hereinafter, this operation is also referred to as "writing"). Then, in the sustain period, a sustain pulse is applied to the display electrode pair including the scan electrode and the sustain electrode alternately and a sustain discharge is generated in a discharge cell in which a writing discharge has been carried out. Thus, a phosphor layer of the corresponding discharge cell is allowed to emit light so as to carry out an image display.

Furthermore, among the subfield methods, a well-known method is a driving method in which an initialization discharge is carried out by using a gradually changing voltage waveform and further an initialization discharge is selectively carried out with respect to a discharge cell in which the sustain discharge has been carried out. Thereby, light emission that is not related to a gradation display is reduced as little as possible so as to improve a contrast ratio.

Specifically, the all-cell initialization operation for discharging all discharge cells in the initialization period of one subfield in the plurality of subfields is carried out, and the selective initialization operation for initializing only a discharge cell in which a sustain discharge has been initialized in the initialization period of the other subfields is carried out. As a result, light emission that is not related to a display is only light emission accompanied with a discharge in all-cell initialization operation, thus enabling an image display with a high contrast (see, for example, patent document 1).

By driving in this way, the brightness of a black display region changing depending upon light emission that does not relate to the image display is only weak light emission in the all-cell initialization operation, thus enabling an image display with a high contrast.

Recently, researches for developing a panel with a higher definition and a larger screen have been done. For example, when discharge cells are made to be fine in order to achieve a higher definition panel, the rate of a non-light emission region is increased, so that the brightness of light emitted per unit area tends to be reduced. In order to increase the brightness of emitted light, it is effective to increase the partial pressure ratio of xenon. However, if the partial pressure ratio is increased, a voltage necessary for writing is increased accordingly, thus making writing unstable. Furthermore, in a panel having a higher definition and a larger screen, the number of electrodes to be formed inside the panel is increased. Consequently, the pulse width of the writing pulse voltage has to be shortened in order not to increase the time necessary for writing. Thus, writing may be unstable.

When an addressing failure occurs due to these problems, a writing discharge is not generated in a discharge cell to be displayed, thus deteriorating the quality of image display.

[Patent document 1] Japanese Patent Unexamined Publication No. 2000-242224

DISCLOSURE OF THE INVENTION

A plasma display device of the present invention includes a panel, a panel temperature and a scan electrode driving circuit. The panel includes a plurality of discharge cells having a plurality of scan electrodes and sustain electrodes constituting a display electrode pair. The panel temperature determination circuit determines a state of temperature of the plasma display panel. The scan electrode driving circuit provides one field period with a plurality of subfields each including an initialization period in which a descending sloping waveform voltage is applied to the scan electrode, a writing period in which a negative scan pulse voltage is applied to the scan electrode, and a sustain period, generating the sloping waveform voltage in the initialization period so as to initialize the discharge cells, and generating the scan pulse voltage in the writing period so as to drive the scan electrode. The scan electrode driving circuit generates the sloping waveform voltage in which a minimum voltage in the sloping waveform voltage is switched between a first voltage and a second voltage having a lower voltage value than that of the first voltage, and changes a ratio in one field period of a subfield in which an initialization is carried out by the sloping waveform voltage whose minimum voltage is the first voltage to a subfield in which an initialization is carried out by the sloping waveform voltage whose minimum voltage is the second voltage, based on the state of temperature of the plasma display panel determined by the panel temperature determination circuit.

Thus, even in a panel having a high brightness and a high definition, it is possible to generate a stable writing discharge without raising a voltage necessary to generate a writing discharge.

REFERENCE MARKS IN THE DRAWINGS

Figure 1:
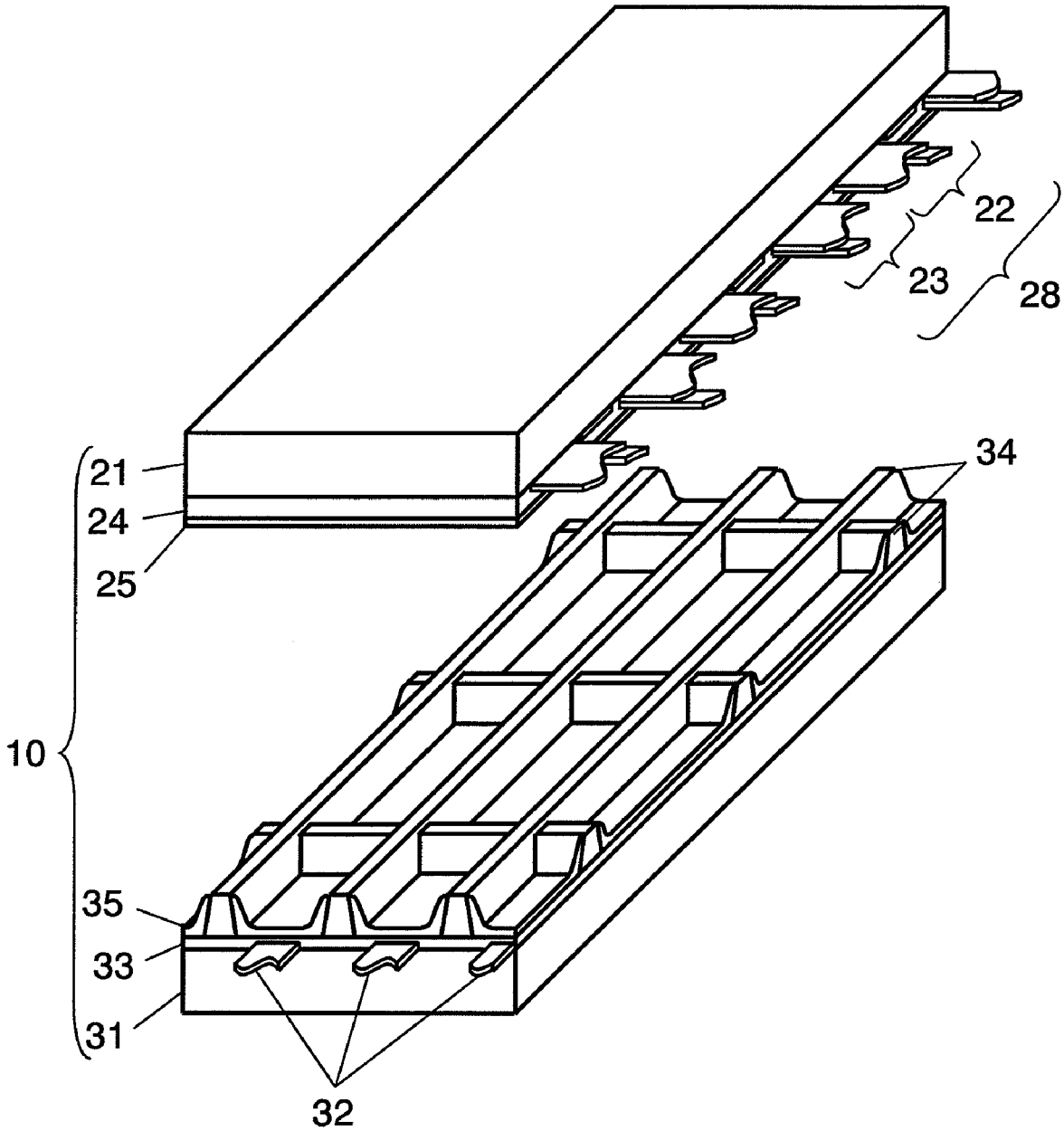
FIG. 1 is an exploded perspective view showing a structure of a panel in accordance with an exemplary embodiment of the present invention.

1 plasma display device
10 panel
21 (glass) front panel
22 scan electrode
23 sustain electrode
24, 33 dielectric layer
25 protective layer
28 display electrode pair
31 rear panel
32 data electrode
34 barrier rib
35 phosphor layer
51 image signal processing circuit
52 data electrode driving circuit
53 scan electrode driving circuit
54 sustain electrode driving circuit
55 timing generating circuit
58 panel temperature determination circuit
81 temperature sensor
100 sustain pulse generating circuit
110 power recovery circuit
300 initialization waveform generating circuit
400 scan pulse generating circuit
Q111, Q112, Q121, Q122, Q311, Q312, Q321, Q322, Q401, QH1 to QHn, QL1 to QLn switching element
C100, C150, C310, C320, C401 capacitor
R310, R320 resistor
INa, INb input terminal
D101, D102, D401 diode
IC1 to ICn control circuit
CP comparator
AG AND gate

DETAILED DESCRIPTION OF THE PREFERRED EMBODIMENTS

Hereinafter, a plasma display device in accordance with an exemplary embodiment of the present invention is described with reference to drawings.

(Exemplary Embodiment)

FIG. 1 is an exploded perspective view showing a structure of panel 10 in accordance with an exemplary embodiment of the present invention. On glass front panel 21, a plurality of display electrode pairs 28 including scan electrode 22 and sustain electrode 23 are formed. Dielectric layer 24 is formed so as to cover scan electrode 22 and sustain electrode 23. Protective layer 25 is formed on dielectric layer 24. A plurality of data electrodes 32 are formed on rear panel 31, and dielectric layer 33 is formed so as to cover data electrodes 32. Furthermore, on dielectric layer 33, barrier ribs 34 are formed in a parallel cross. Then, on the side surface of barrier ribs 34 and on the surface of dielectric layer 33, phosphor layer 35 emitting light in red (R), green (G) and blue (B) is provided.

Front panel 21 and rear panel 31 are disposed facing each other so that display electrode pairs 28 and data electrodes 32 intersect with each other with extremely small discharge space interposed therebetween with peripheral portions thereof sealed to each other with a sealing agent such as glass frit. For example, a mixture gas including neon and xenon as a discharge gas is filled in the discharge space. In this exemplary embodiment, for improving the brightness, a discharge gas having the partial pressure of xenon of about 10% is used. The discharge space is separated into a plurality of sections by barrier ribs 34. Discharge cells are formed in portions where display electrode pair 28 and data electrode 32 intersect with each other. Then, these discharge cells discharge and emit light. Thereby, an image display is carried out.

Note here that the structure of panel 10 is not necessarily limited to the above-mentioned structure and may include stripe-shaped barrier ribs. Furthermore, the mixing ratio of the discharge gas is not necessarily limited to the above-mentioned ratio and may be any other mixing ratios.

Figure 2:
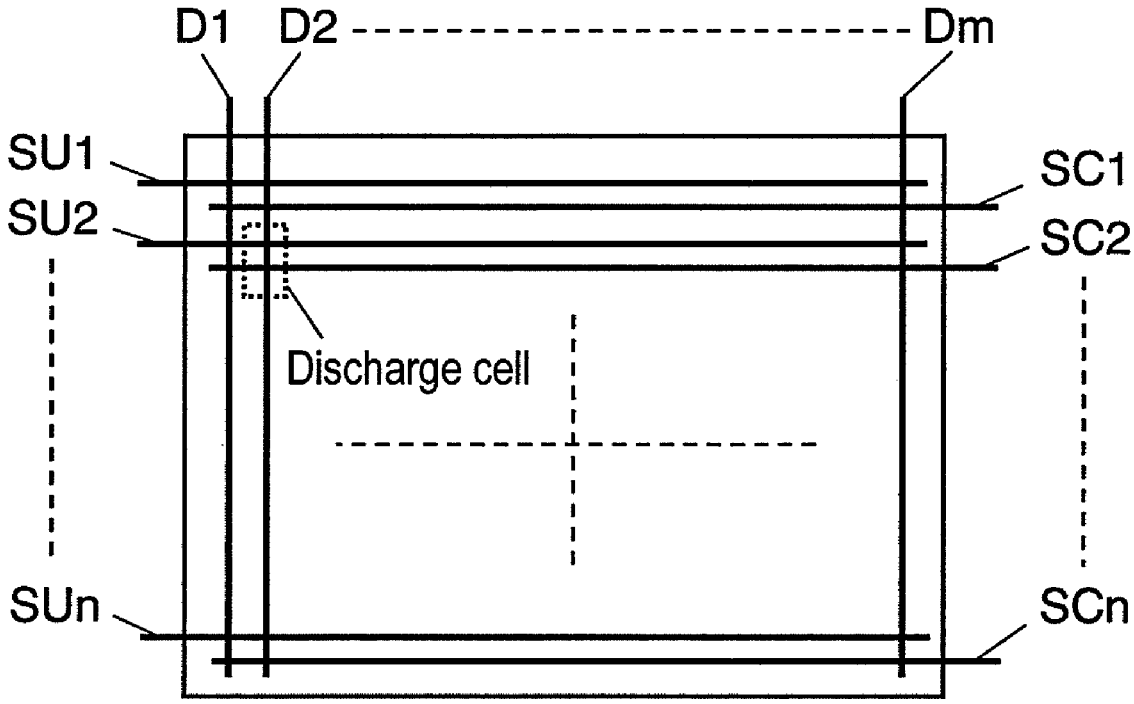
FIG. 2 is a view showing an arrangement of electrodes of the panel.

FIG. 2 is a view showing an arrangement of electrodes of panel 10 in accordance with the exemplary embodiment of the present invention. On panel 10, n columns of scan electrodes SC1 to SCn (scan electrodes 22 in FIG. 1) and n columns of sustain electrodes SU1 to SUn (sustain electrodes 23 in FIG. 1), which are long in the row direction, are arranged as well as m rows of data electrodes D1 to Dm (data electrodes 32 in FIG. 1) which are long in the column direction are arranged. In a portion where a pair of scan electrode SCi (i=1 to n) and sustain electrode SUi intersects with one data electrode Dj (j=1 to m), a discharge cell is formed. M×n pieces of the discharge cells are formed in discharge space.

Next, a drive voltage waveform for driving panel 10 and an operation thereof are described. The plasma display device in this exemplary embodiment carries out a subfield method. In this method, one field period is divided into a plurality of subfields and gradation display is carried out by controlling whether emitting light or not emitting light for every subfield. Each subfield has an initialization period, a writing period and a sustain period.

In the initialization period, an initialization discharge is generated on each electrode so as to form a wall charge necessary for the following writing operation. The initialization operation at this time includes an all-cell initialization operation in which an initialization discharge is generated in all the discharge cells and a selective initialization operation in which an initialization discharge is generated in a discharge cell in which a sustain discharge has been carried out in the one preceding subfield.

In the writing period, a writing discharge is generated selectively in a discharge cell in which light is to be emitted in the following sustain period and a wall charge is formed. Furthermore, in the sustain period, sustain pulses are applied to display electrode pair 28 alternately so as to generate sustain discharge in a discharge cell in which the writing discharge has been generated and thus light is emitted. The number of the sustain pulses is in proportion to the brightness weight. A proportionality constant at this time is referred to as "brightness scaling factor."

Figure 3:
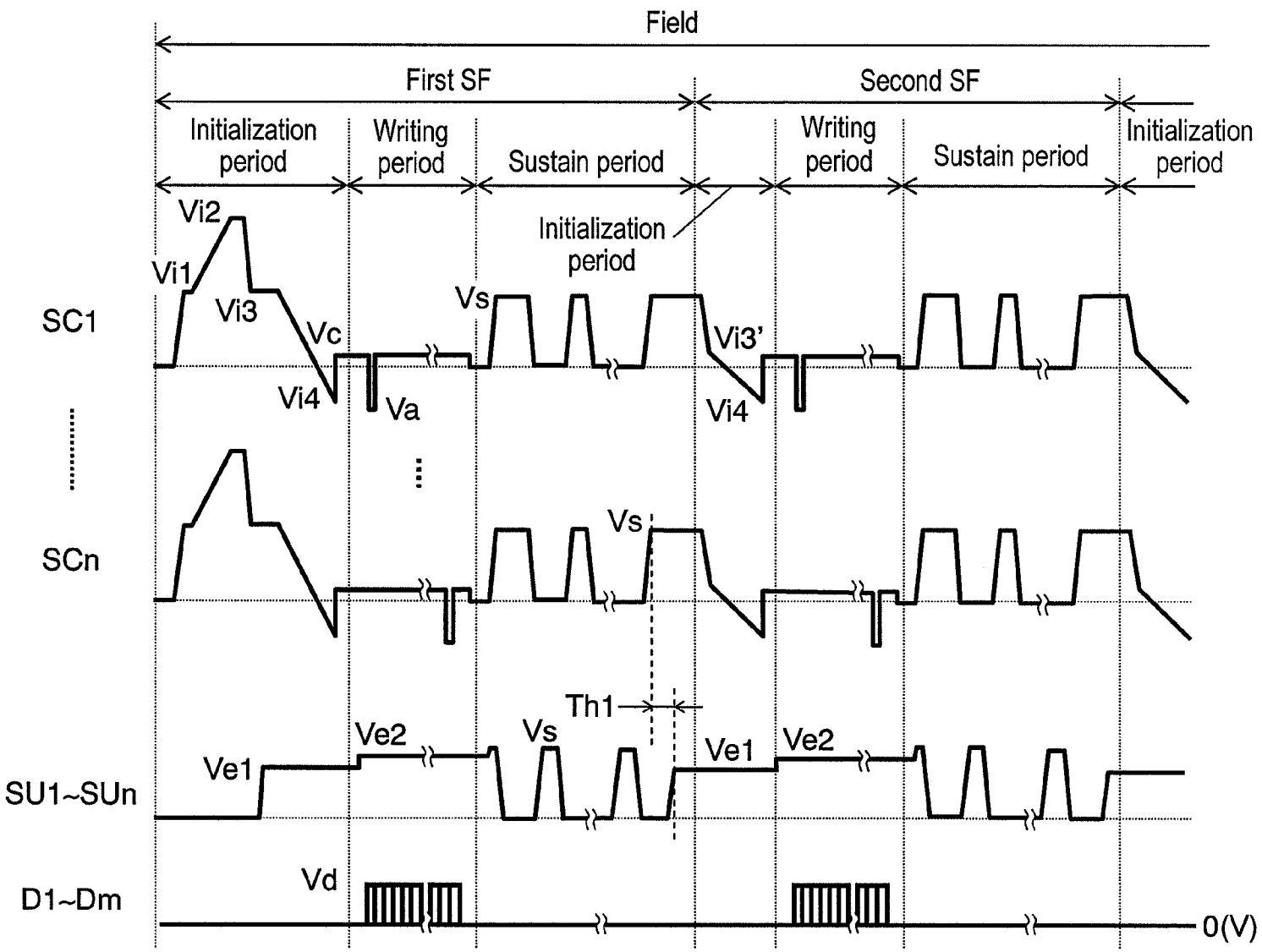
FIG. 3 is a waveform diagram of driving voltage applied to each electrode of the panel.

FIG. 3 is a waveform diagram of a driving voltage applied to each electrode of panel 10 in accordance with the exemplary embodiment of the present invention. FIG. 3 shows driving voltage waveforms of two subfields, that is, a subfield in which the all-cell initialization operation is carried out (hereinafter, referred to as an "all-cell initialization subfield") and a subfield in which the selective initialization operation is carried out (hereinafter, referred to as a "selective initialization subfield"). However, driving voltage waveforms in other subfields are substantially similar.

Firstly, a first SF, that is, the all-cell initialization subfield is described.

In the former part of the initialization period of the first SF, 0 (V) is applied to data electrodes D1 to Dm and sustain electrodes SU1 to SUn, respectively. To scan electrodes SC1 to SCn, a sloping waveform voltage gradually rising from voltage Vi1 that is not more than a discharge starting voltage with respect to sustain electrodes SU1 to SUn toward voltage Vi2 that is more than the discharge starting voltage (hereinafter, referred to as a "rising ramp waveform voltage") is applied.

While this sloping waveform voltage is increased, in scan electrodes SC1 to SCn, sustain electrodes SU1 to SUn and data electrodes D1 to Dm, a weak initialization discharge is generated. Then, a negative wall voltage is accumulated on scan electrodes SC1 to SCn, and a positive wall voltage is accumulated on data electrodes D1 to Dm and on sustain electrodes SU1 to SUn. Herein, the wall voltage on the electrode denotes a voltage generated by wall charges accumulated on the dielectric layer, the protective layer, the phosphor layer, and the like, covering the electrodes.

In the latter part of the initialization period, positive voltage Ve1 is applied to sustain electrodes SU1 to SUn, and a sloping waveform voltage gradually descending from voltage Vi3 that is not more than a discharge starting voltage with respect to sustain electrodes SU1 to SUn toward voltage Vi4 that is more than the discharge starting voltage (hereinafter, referred to as a "descending ramp waveform voltage") is applied to scan electrodes SC1 to SCn (hereinafter, the minimum value of the descending ramp waveform voltage applied to scan electrodes SC1 to SCn is referred to as "initialization voltage Vi4"). During this time, in scan electrodes SC1 to SCn, sustain electrodes SU1 to SUn, and data electrodes D1 to Dm, a weak initialization discharge is generated. Then, the negative wall voltage on scan electrodes SC1 to SCn and the positive wall voltage on sustain electrodes SU1 to SUn are weakened, and the positive voltage on data electrodes D1 to Dm is adjusted to the values suitable for a writing operation. From the above, the all-cell initialization operation, in which an initialization discharge is carried out in all the discharge, is completed.

Herein, this exemplary embodiment shows a configuration in which a voltage value of initialization voltage Vi4 is switched between two different voltage values and panel 10 is driven. Hereinafter, a higher voltage value is defined as Vi4H and a lower voltage value is defined as Vi4L.

In the subsequent writing period, voltage Ve2 is applied to sustain electrodes SU1 to SUn and voltage Vc is applied to scan electrodes SC1 to SCn.

Firstly, negative scan pulse voltage Va is applied to scan electrode SC1 in the first row, and at the same time, positive writing pulse voltage Vd is applied to data electrode Dk (k=1 to m) among data electrodes D1 to Dm in the discharge cell to emit light in the first row. At this time, a voltage difference on the intersectional part of data electrode Dk and scan electrode SC1 is a voltage obtained by adding a voltage difference between the wall voltage on data electrode Dk and the wall voltage on scan electrode SC1 to voltage difference (Vd−Va) of the external applied voltages, and this calculated voltage exceeds the discharge starting voltage. Then, writing discharge is generated between data electrode Dk and scan electrode SC1 as well as between sustain electrode SU1 and scan electrode SC1. A positive wall voltage is accumulated on the scan electrode SC1 and a negative wall voltage is accumulated on sustain electrode SU1. Also on data electrode Dk, a negative wall voltage is accumulated.

Thus, a writing operation is carried out, in which a writing discharge is generated in a discharge cell to emit light in the first row so as to accumulate a wall voltage on each electrode. On the other hand, since a voltage in the intersectional portion between data electrodes D1 to Dm to which writing pulse voltage Vd has not been applied and scan electrode SC1 does not exceed the discharge starting voltage, a writing discharge is not generated. The above-mentioned writing operation is carried out to discharge cells until the n-th row. Thus, the writing period is completed.

In the subsequent sustain period, firstly, positive sustain pulse voltage Vs is applied to scan electrodes SC1 to SCn and at the same time, 0 (V) is applied to sustain electrodes SU1 to SUn. Then, in the discharge cell in which a writing discharge has been carried out in the preceding writing period, a difference between the voltage on the scan electrode SCi and the voltage on the sustain electrode SUi is a voltage obtained by adding the difference of the wall voltage between the wall voltage on scan electrode SCi and the wall voltage on sustain electrode SUi to sustain pulse voltage Vs. The calculated voltage exceeds the discharge starting voltage.

Then, between scan electrode SCi and sustain electrode SUi, a sustain discharge occurs. With an ultraviolet ray generated at this time, phosphor layer 35 emits light. Then, a negative wall voltage is accumulated on scan electrode SCi and a positive wall voltage is accumulated on sustain electrode SUi. Furthermore, a positive wall voltage is also accumulated on data electrode Dk. In the discharge cell in which a writing discharge has not been generated during the writing period, a sustain discharge is not generated and the wall voltage at the time when the initialization period ends is maintained.

Subsequently, 0 (V) is applied to scan electrodes SC1 to SCn and sustain pulse voltage Vs is applied to electrodes SU1 to SUn. Then, in the discharge cell in which the sustain discharge has been generated, since the difference between the voltage on sustain electrode SUi and the voltage on scan electrode SCi exceeds the discharge starting voltage, a sustain discharge is generated again between sustain electrode SUi and scan electrode SCi. Thus, a negative wall voltage is accumulated on sustain electrode SUi and a positive wall voltage is accumulated on scan electrode SCi. Later, similarly, sustain pulses are alternately applied to scan electrodes SC1 to SCn and sustain electrodes SU1 to SUn so as to provide a potential difference between electrodes of the electrode pair. The number of the sustain pulses is a predetermined number obtained by multiplying the brightness weight by the brightness scaling factor. Thereby, the sustain discharge is continued to be carried out in the discharge cell in which a writing discharge has been carried out in the writing period.

Then, at the end of the sustain period, voltage Vs is applied to scan electrodes SC1 to SCn. Predetermined time Th1 later, voltage Ve1 is applied to sustain electrodes SU1 to SUn. Thereby, a so-called narrow width pulse of voltage difference is given between scan electrodes SC1 to SCn and sustain electrodes SU1 to SUn. Thus, a part of or all the wall voltage on scan electrode SCi and sustain electrode SUi is deleted with a positive wall voltage remained on data electrode Dk. Specifically, sustain electrodes SU1 to SUn are once returned to 0 (V), thereafter, sustain pulse voltage Vs is applied to scan electrodes SC1 to SCn. Then, between sustain electrode SUi in a discharge cell, in which a sustain discharge is generated, and scan electrode SCi, a sustain discharge is generated. Then, before this discharge is convergent, that is, while charged particles generated by discharge sufficiently remain in discharge space, voltage Ve1 is applied to sustain electrodes SU1 to SUn. Thus, the voltage difference between sustain electrode SUi and scan electrode SCi is Weakened to the level of the voltage difference (Vs−Ve1). Then, the wall voltage between scan electrodes SC1 to SCn and sustain electrodes SU1 to SUn is weakened to the level of the voltage difference (Vs−Ve1) that is the difference between voltage applied to electrodes while the positive wall charge on data electrode Dk remains. Hereinafter, this discharge is referred to as "erase discharge."

Thus, after a predetermined time interval after voltage Vs for generating the last sustain discharge, i.e., the erase discharge has been applied to scan electrodes SC1 to SCn, voltage Ve1 for decreasing the potential difference between electrodes of display electrode pair is applied to sustain electrode SU1 to SUn. Thus, the sustain operation in the sustain period is completed.

Next, an operation of a second SF that is a selective initialization subfield is described.

In the selective initialization period in the second SF, in a state in which voltage Ve1 is applied to sustain electrodes SU1 to SUn and 0 (V) is applied to data electrodes D1 to Dm, respectively, a descending ramp waveform voltage gradually descending from voltage Vi3' to voltage Vi4 is applied to scan electrodes SC1 to SCn.

Then, in the discharge cell in which the sustain discharge has been generated in the sustain period in the preceding subfield, a weak initialization discharge is generated and wall voltages on scan electrode SCi and on sustain electrode SUi are weakened. Furthermore, with respect to data electrode Dk, since a sufficient amount of positive wall voltage is accumulated on data electrode Dk by the immediately preceding sustain discharge, an excess portion of this wall voltage is discharged so that the voltage is adjusted to the wall voltage suitable for a writing operation.

On the other hand, a discharge is not carried out in the discharge cell in which a sustain discharge has not been carried out in the preceding subfield, the wall charge at the time when the initialization period of the preceding subfield is finished is maintained as it is. In this way, the selective initialization operation is an operation for selectively carrying out an initialization discharge with respect to the discharge cell in which a sustain operation is carried out in the sustain period in the immediately preceding subfield.

Then, in this exemplary embodiment, also in the selective initialization operation, similar to the descending ramp waveform voltage in the all-cell initialization operation, initialization voltage Vi4 is switched between higher voltage value Vi4H and lower voltage value Vi4L.

Since an operation in the subsequent writing period is the same as the writing period of the operation in the all-cell initialization subfield, the description therefore is omitted. An operation in the subsequent sustain period is also the same except for the number of sustain pulses.

As mentioned above, in the exemplary embodiment, in the initialization period, the voltage value of initialization voltage Vi4, which is a minimum voltage of the descending ramp waveform voltage, is switched between two different voltage values, that is, Vi4H as the first voltage and Vi4L as the second voltage that has a lower than the first voltage so as to form a descending ramp waveform voltage. Then, in accordance with the state of temperature of panel 10 determined by a below-mentioned panel temperature determination circuit, the ratio in one field period of the subfield in which an initialization is carried out by a descending ramp waveform voltage whose voltage value of initialization voltage Vi4 is Vi4L is changed. Thus, a stable writing discharge is realized.

Figure 4:
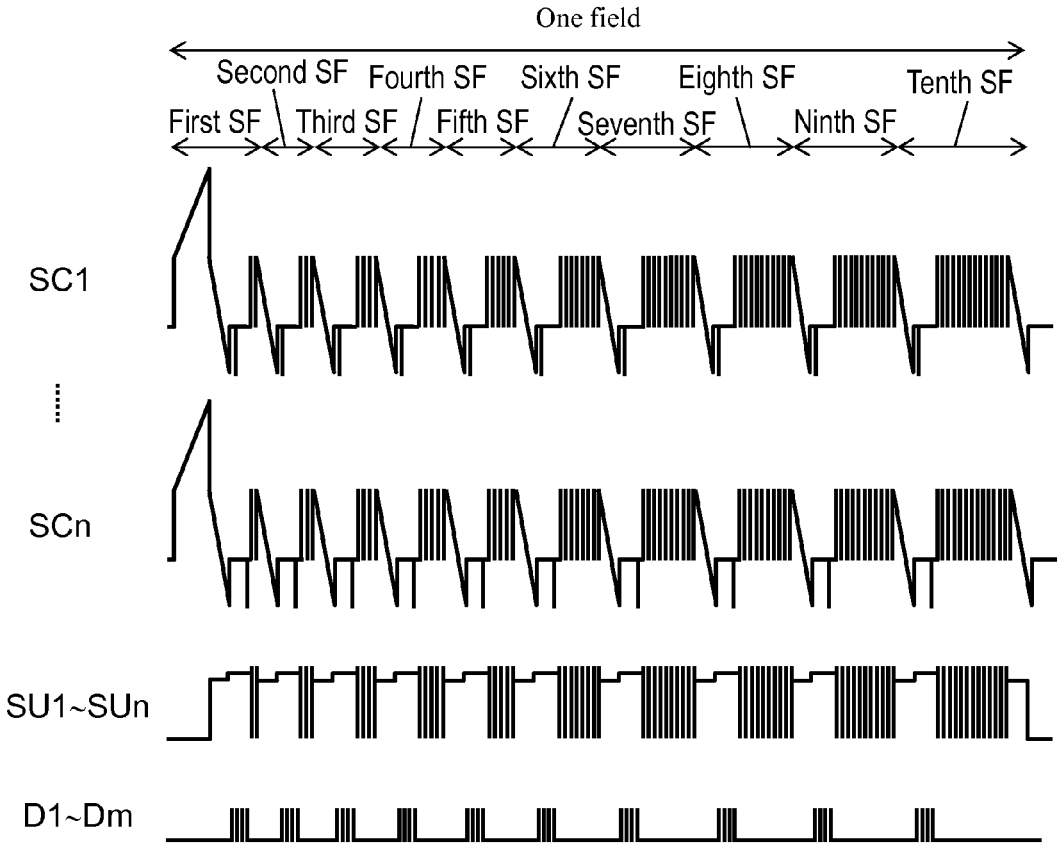
FIG. 4 is a schematic view showing a driving waveform showing a subfield configuration in an exemplary embodiment of the present invention.
Figure 5A:
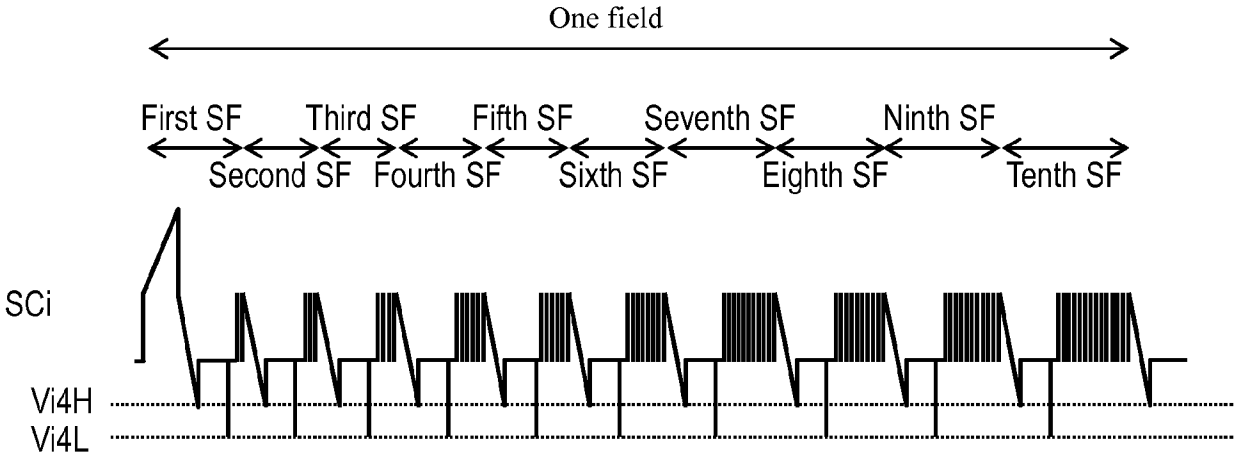
FIG. 5A is a schematic view showing a driving waveform showing a subfield configuration in an exemplary embodiment of the present invention.
Figure 5B:
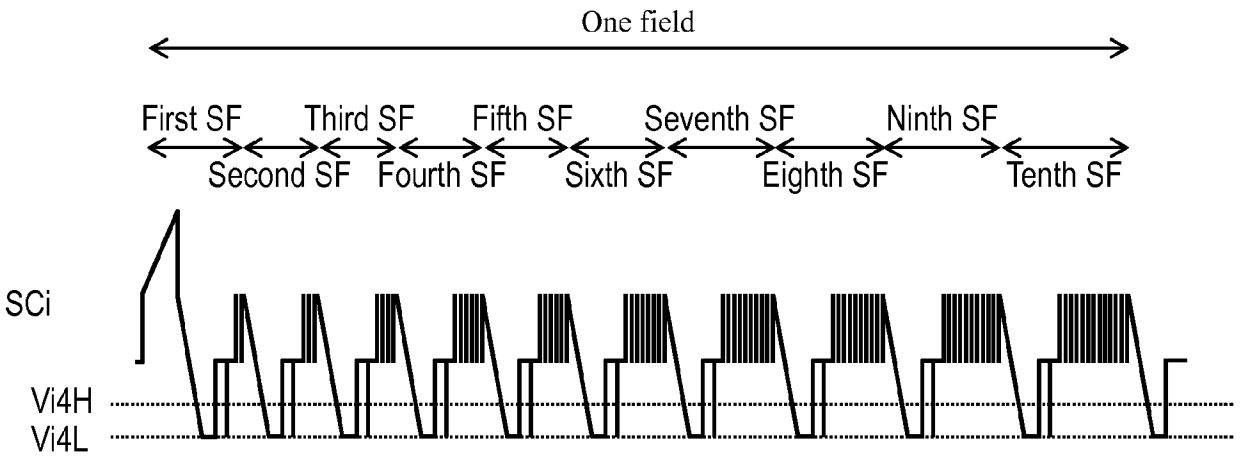
FIG. 5B is a schematic view showing a driving waveform showing a subfield configuration in an exemplary embodiment of the present invention.

Next, a subfield configuration is described. FIGS. 4, 5A and 5B are schematic views showing a drive waveform of a subfield configuration in accordance with the exemplary embodiment of the present invention. Note here that FIGS. 4, 5A and 5B schematically show a drive waveform in one field in the subfield method. The drive voltage waveform of the respective subfield is the same as the drive voltage waveform of FIG. 3.

In FIGS. 4, 5A and 5B, one field is divided into ten subfields (first SF, second SF, . . . , tenth SF) and each subfield has a subfield configuration having a brightness weight of, for example, 1, 2, 3, 6, 11, 18, 30, 44, 60, 80. In this exemplary embodiment, in the initialization period of the first SF, an all-cell initialization operation is carried out and in the initialization periods of the second to tenth SFs, a selective initialization operation is carried out. Furthermore, in the sustain period of each subfield, sustain pulses are applied to the display electrode pair, respectively. The number of the sustain pulse is a predetermined number obtained by multiplying the brightness weight of each subfield by a brightness scaling factor.

However, in this exemplary embodiment, the number of subfields and the brightness weight of each subfield are not necessarily limited to the above-mentioned values. Furthermore, the subfield configuration may be switched based on an image signal and the like.

Then, as mentioned above, the voltage values of initialization voltage Vi4 of the descending ramp waveform voltage is switched between two different voltage values, that is, Vi4H having a higher voltage value and Vi4L having a voltage value that is lower than that of Vi4H so as to form a descending ramp waveform voltage. Then, in accordance with the state of temperature of panel 10 determined by the below-mentioned panel temperature determination circuit, the ratio in one field period of the subfield in which an initialization is carried out by a descending ramp waveform voltage whose voltage value of initialization voltage Vi4 is Vi4L is changed.

Specifically, in a case where the panel temperature determination circuit determines that the state of temperature of panel 10 is not low, as shown in FIG. 5A, in the initialization periods of all subfields, a descending ramp waveform voltage whose initialization voltage Vi4 is Vi4H is generated and initialization is carried out.

In a case where the panel temperature determination circuit determines that the state of temperature of panel 10 is low, as shown in FIG. 5B, in the initialization periods of all subfields, a descending ramp waveform voltage whose initialization voltage Vi4 is Vi4L is generated and an initialization is carried out. In this exemplary embodiment, with such a configuration, a stable writing discharge is realized. This is based on the following reasons.

In the initialization period in which wall charge necessary for the writing discharge is formed on each electrode, by applying a descending ramp waveform voltage to scan electrodes SC1 to SCn, an initialization discharge is generated. Therefore, according to the voltage value of initialization voltage Vi4 that is a minimum voltage in the descending ramp waveform voltage, the wall charge formed on each electrode is changed and an applied voltage necessary for the subsequent writing discharge is changed.

Figure 6:
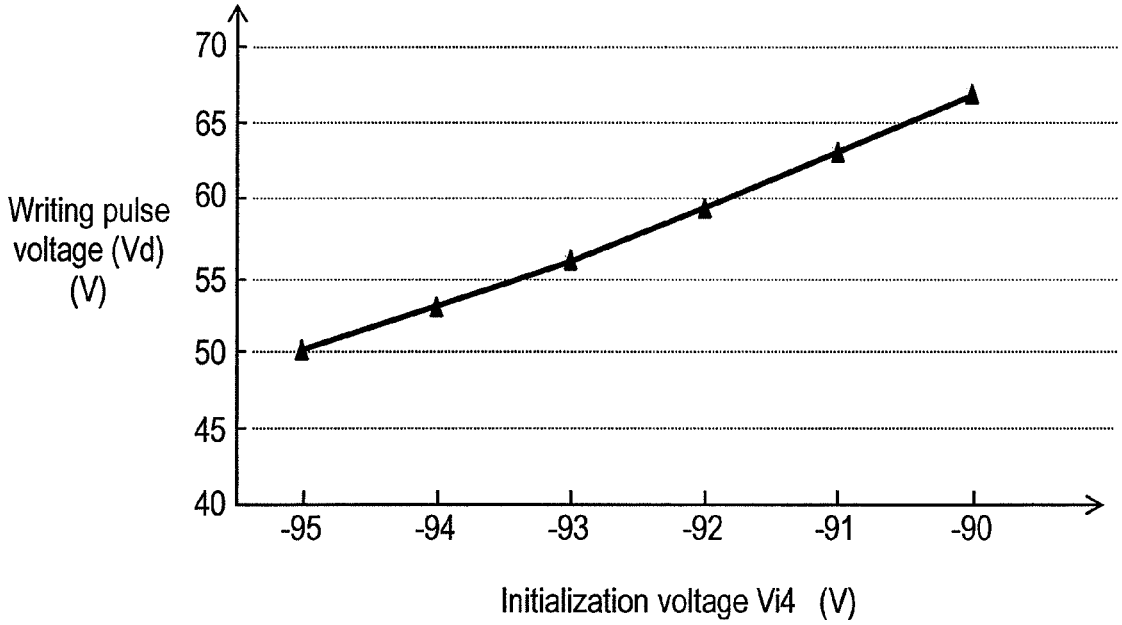
FIG. 6 is a graph showing the relation between initialization voltage Vi4 and a writing pulse voltage in accordance with an exemplary embodiment of the present invention.

FIG. 6 is a graph showing the relation between initialization voltage Vi4 and a writing pulse voltage in accordance with the exemplary embodiment of the present invention. In FIG. 6, the ordinate shows writing pulse voltage Vd necessary to generate a stable writing discharge and the abscissa shows initialization voltage Vi4.

As shown in FIG. 6, as the initialization voltage Vi4 is lower, it is possible to reduce writing pulse voltage Vd necessary to generate a stable writing discharge. For example, while writing pulse voltage Vd at the time when initialization voltage Vi4 is about −90 (V) is about 66 (V), writing pulse voltage Vd at the time when initialization voltage Vi4 is about −95 (V) is about 50 (V). Thus, by reducing the initialization voltage Vi4 from about −90 (V) to about −95 (V), writing pulse voltage Vd necessary to generate a stable writing discharge can be reduced by about 16 (V).

Figure 7:
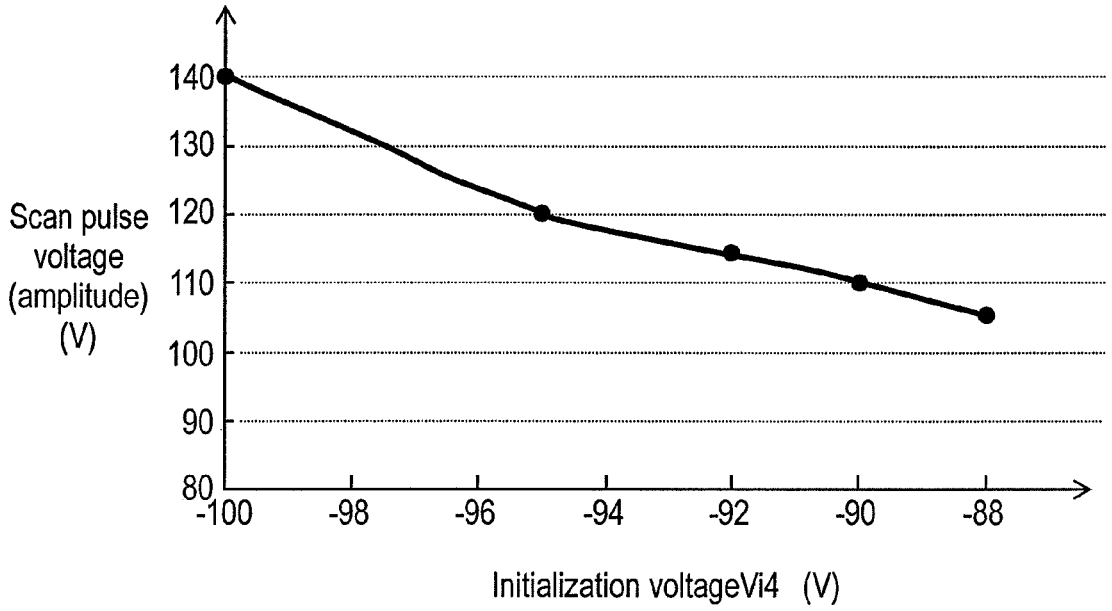
FIG. 7 is a graph showing the relation between initialization voltage Vi4 and a scan pulse voltage in accordance with an exemplary embodiment of the present invention.

On the other hand, between initialization voltage Vi4 and scan pulse voltage Va necessary to generate a stable writing discharge, there is a following relationship. FIG. 7 is a graph showing the relation between initialization voltage Vi4 and a scan pulse voltage in accordance with the exemplary embodiment of the present invention. In FIG. 7, the ordinate shows a scan pulse voltage (amplitude) necessary to generate a stable writing discharge, and the abscissa shows initialization voltage Vi4.

Then, as shown in FIG. 7, as the initialization voltage Vi4 is lower, scan pulse voltage Va necessary to generate a stable writing discharge is increased. For example, while the amplitude of the scan pulse voltage at the time when initialization voltage Vi4 is about −90 (V) is about 110 (V), the amplitude of the scan pulse voltage at the time when initialization voltage Vi4 is about −95 (V) is about 120 (V). Thus, by changing initialization voltage Vi4 from about −90 (V) to about −95 (V), scan pulse voltage Va necessary to generate a stable writing discharge is increased by as much as about 10 (V).

Thus, when initialization voltage Vi4 is reduced, writing pulse voltage Vd necessary to generate a stable writing discharge can be reduced. On the contrary, however, scan pulse voltage Va necessary to generate a stable writing discharge is increased.

Meanwhile, the discharging characteristic is changed depending upon the temperature of panel 10, and factors such as a discharge delay (a time delay from the time when a voltage for generating a discharge is applied to the discharge cell to the time when a discharge is actually generated) and dark current (current generated inside the discharge cell irrelevant to the discharge), which make the discharge unstable, are also changed depending upon the temperature of panel 10. Furthermore, it is known that when the temperature of panel 10 becomes lower, a dark current in the discharge cell is changed and the deletion of wall charges (hereinafter, referred to as "charge decrease") is increased. Therefore, the applied voltage necessary to generate a stable writing discharge is changed depending upon the temperature of panel 10.

Figure 8:
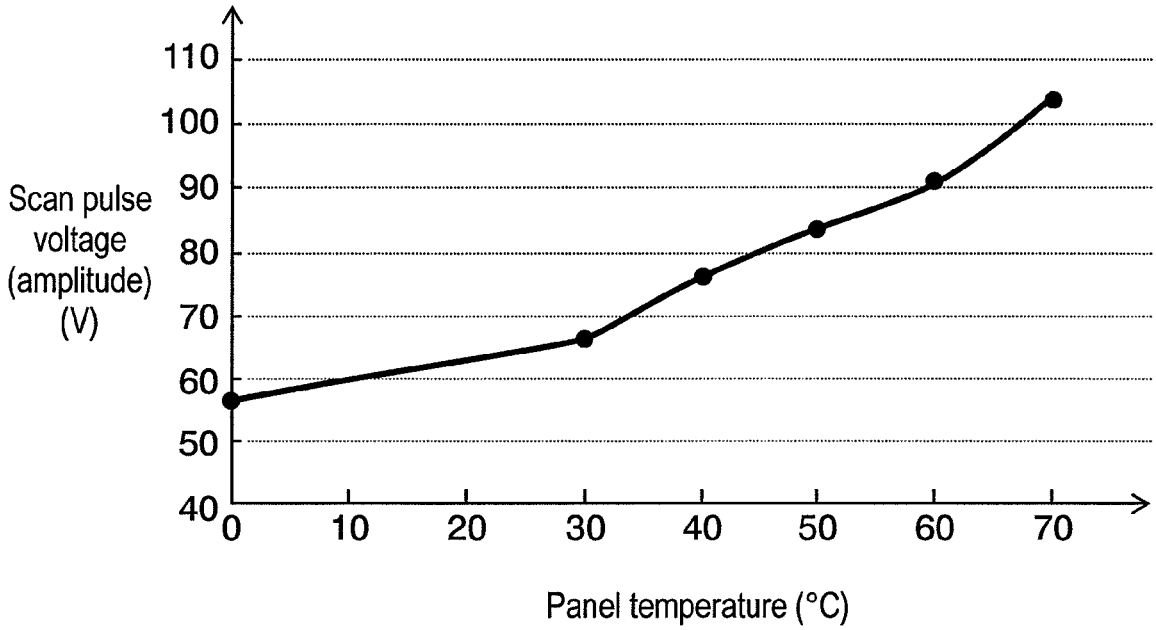
FIG. 8 is a graph showing the relation between a temperature of the panel and the scan pulse voltage in accordance with an exemplary embodiment of the present invention.

FIG. 8 is a graph showing the relation between a temperature of the panel and a scan pulse voltage in accordance with the exemplary embodiment of the present invention. In FIG. 8, the ordinate shows a scan pulse voltage (amplitude) necessary to generate a stable writing discharge and the abscissa shows the temperature of panel 10.

As shown in FIG. 8, as the temperature of panel 10 becomes lower, scan pulse voltage Va necessary to generate a stable writing discharge is reduced. For example, the amplitude of the scan pulse voltage at the time when the temperature of panel 10 is about 70° C. is about 104 (V), meanwhile the amplitude of the scan pulse voltage at the time when the temperature of panel 10 is about 30° C. is about 66 (V). When the temperature of panel 10 is about 30 (° C.), scan pulse voltage Va necessary to generate a stable writing discharge becomes lower by as much as about 38 (V) as compared with the time when the temperature of panel 10 is about 70 (° C.).

That is to say, since scan pulse voltage Va necessary to generate a stable writing discharge is reduced when the temperature of panel 10 is low, it is possible to set initialization voltage Vi4 to be low.

Then, in this exemplary embodiment, when the panel temperature determination circuit determines that a state of temperature of panel 10 is low, initialization voltage Vi4 is set to Vi4L that is lower voltage value than Vi4H. Thus, writing pulse voltage Vd necessary to generate a stable writing discharge can be reduced and writing pulse voltage Vd actually applied to data electrodes D1 to Dm is increased relative to writing pulse voltage Vd necessary to allow the stable writing, thus realizing a stable writing. Furthermore, an initialization discharge generated by applying a descending ramp waveform voltage to scan electrodes SC1 to SCn has a function of weakening the wall voltage on data electrodes D1 to Dm. However, since it is possible to make the descending ramp waveform voltage deep so as to increase the discharge period of the initialization discharge by setting initialization voltage Vi4 to be Vi4L, the function of weakening the wall voltage on data electrodes D1 to Dm is enhanced and the wall voltage can be lowered. Thus, deprivation of the wall charge of the discharge cell in a row that is not selected can be reduced, and a charge decrease that tends to occur at low temperature can be prevented.

Note here that this experiment is carried out by using a 50-inch panel having 1080 pairs of display electrode pairs. The above-mentioned numeric values are based on the panel and not necessarily limited to this exemplary embodiment.

Figure 9:
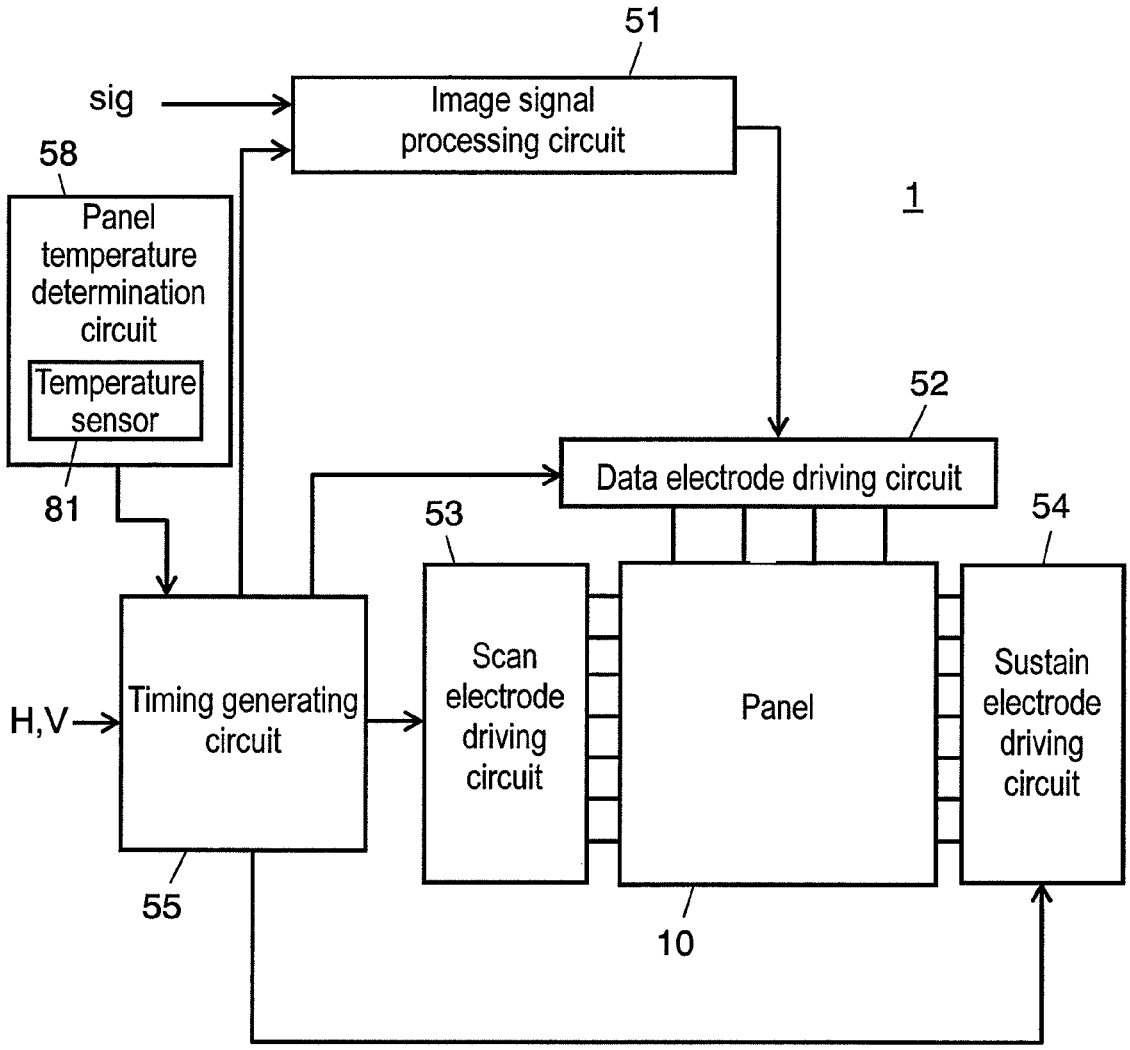
FIG. 9 is a circuit block diagram showing a plasma display device in accordance with the exemplary embodiment of the present invention.

A plasma display device in accordance with this exemplary embodiment is described. FIG. 9 is a circuit block diagram showing a plasma display device in accordance with the exemplary embodiment of the present invention. Plasma display device 1 includes panel 10, image signal processing circuit 51, data electrode driving circuit 52, scan electrode driving circuit 53, sustain electrode driving circuit 54, timing generating circuit 55, panel temperature determination circuit 58 and a power circuit (not shown) for supplying power source necessary for each circuit block.

Image signal processing circuit 51 converts the input image signals sig into image data showing whether emitting light or not emitting light for every subfield. Data electrode driving circuit 52 converts image data for every subfield into a signal corresponding to each of data electrodes D1 to Dm so as to drive each of data electrodes D1 to Dm.

Panel temperature determination circuit 58 has temperature sensor 81 including a generally known element such as thermocouple used for detecting a temperature. From a temperature in peripheral portion of panel 10, which is detected by temperature sensor 81, that is, a temperature inside a case, an estimate value of the temperature of panel 10 (hereinafter, referred to as "panel temperature") is calculated. As the method for calculating the panel temperature, for example, a method for adding a predetermined correction value to a temperature detected by temperature sensor 81 can be used. Then, by comparing the calculated panel temperature with the predetermined low-temperature threshold value, it is determined whether or not the panel temperature is low temperature. When the result of the determination is switched, a signal showing this result is output to timing generating circuit 55. Specifically, when it is determined that the panel temperature is changed from a low temperature state to a not low temperature state, that is, when the panel temperature is changed from a temperature less than the low-temperature threshold value to a temperature not less than the low-temperature threshold value, and when it is determined that the panel temperature is changed from a not low temperature state to a low temperature state, that is, when the panel temperature is changed from a temperature not less than the low-temperature threshold value or more to a temperature less than the low-temperature threshold value, a signal showing that the panel temperature is switched is output to timing generating circuit 55.

In this exemplary embodiment, the low-temperature threshold value is set to 5° C. However, the value is not necessarily limited to this numeric value. It is desirable to set to an optimum value based on the property of the panel or the specification of the plasma display device, and the like.

Timing generating circuit 55 generates various timing signals for controlling an operation of each circuit block based on horizontal synchronizing signal H, vertical synchronizing signal V and a state of temperature of panel 10 determined by panel temperature determination circuit 58, and supplies the signals to each circuit block. Then, as mentioned above, in this exemplary embodiment, initialization voltage Vi4 of the descending ramp waveform voltage applied to scan electrodes SC1 to SCn in the initialization period is controlled based on the panel temperature and outputs the corresponding timing signal to scan electrode driving circuit 53, thus controlling the writing operation to be stabilized.

Scan electrode driving circuit 53 includes an initialization waveform generating circuit for generating an initialization waveform to be applied to scan electrodes SC1 to SCn in the initialization period, a sustain pulse generating circuit for generating a sustain pulse to be applied to scan electrodes SC1 to SCn in the sustain period, and a scan pulse generating circuit for generating a scan pulse voltage to be applied to scan electrodes SC1 to SCn in the writing period. Scan electrode driving circuit 53 drives each of the scan electrodes SC1 to SCn based on the timing signal. Sustain electrode driving circuit 54 drives sustain electrode SU1 to SUn based on the timing signal.

Figure 10:
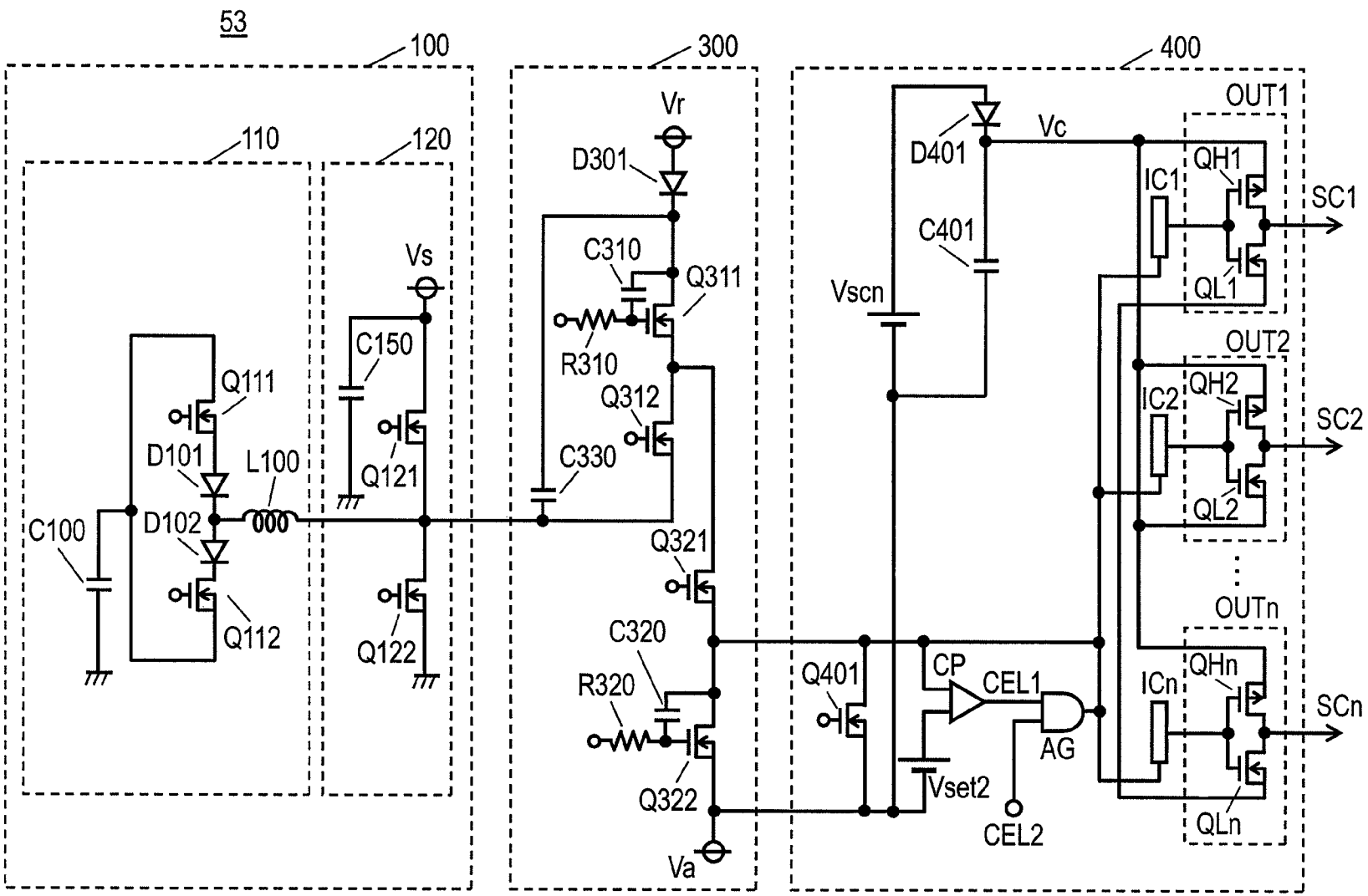
FIG. 10 is a circuit diagram of a scan electrode driving circuit in accordance with the exemplary embodiment of the present invention.

Next, the detail of scan electrode driving circuit 53 and an operation thereof are described. FIG. 10 is a circuit diagram of scan electrode driving circuit 53 in accordance with the exemplary embodiment of the present invention. Scan electrode driving circuit 53 includes sustain pulse generating circuit 100 for generating a sustain pulse, initialization waveform generating circuit 300 for generating an initialization waveform, and scan pulse generating circuit 400 for generating a scan pulse.

Sustain pulse generating circuit 100 includes power recovery circuit 110 and clamping circuit 120. Power recovery circuit 110 includes capacitor C100 for recovering electric power, switching element Q111, switching element Q112, diodes D101 and D102 for preventing back-flow, and inductor L100 for resonance. Capacitor C100 for recovering electric power has a capacity larger than capacity Cp between electrodes and is charged to about Vs/2, i.e., a half of the below mentioned voltage value Vs so that it works as an electric power supply of power recovery circuit 110. Clamping circuit 120 has switching element Q121 for clamping scan electrodes SC1 to SCn to voltage Vs, and switching element Q122 for clamping scan electrode SC1 to SCn to 0 (V). Furthermore, it has smoothing capacity C150 for reducing the impedance of voltage source Vs. Then, sustain pulse voltage Vs is generated based on the timing signal output from timing generating circuit 55.

Initialization waveform generating circuit 300 includes a Miller integrating circuit having switching element Q311, capacitor C310 and resistor R310 and generating a rising ramp waveform voltage gradually rising to predetermined initialization voltage Vi2 in a ramp form; a Miller integrating circuit having switching element Q322, capacitor C320 and resistor R320 and generating a descending ramp waveform voltage gradually descending to a predetermined initialization voltage Vi4 in a ramp form; an isolating circuit using switching element Q312 and an isolating circuit using switching element Q321. Then, the above-mentioned initialization waveform is generated based on the timing signal output from timing generating circuit 55, and at the same time, control of initialization voltage Vi2 in the all-cell initialization operation is carried out. Note here that in FIG. 10, input terminals of the Miller integrating circuit are shown by input terminal INa and input terminal INb.

Scan pulse generating circuit 400 includes switching circuits OUT1 to OUTn for outputting a scan pulse voltage to each of scan electrodes SC1 to SCn; switching element Q401 for clamping the lower voltage side of switching circuits OUT1 to OUTn to voltage Va; control circuits IC1 to ICn for controlling switching circuits OUT1 to OUTn; diode D401 for applying voltage Vc obtained by superimposing voltage Vscn to voltage Va to the higher voltage side of switching circuits OUT1 to OUTn; and capacitor C401. Each of switching circuits OUT1 to OUTn includes switching elements QH1 to QHn for outputting voltage Vc and switching elements QL1 to QLn for outputting voltage Va. Then, based on the timing signal output from timing generating circuit 55, scan pulse voltage Va to be applied to scan electrodes SC1 to SCn in the writing period is generated sequentially. Scan pulse generating circuit 400 outputs voltage waveform of initialization waveform generating circuit 300 as it is in the initialization period and outputs a voltage waveform of sustain pulse generating circuit 100 as it is in the sustain period.

Herein, since an extremely large current flows in switching elements Q121, Q122, Q312 and Q321, in these switching elements, a plurality of FETs, IGBTs, and the like, are coupled in parallel so as to reduce impedance.

Furthermore, scan pulse generating circuit 400 includes AND gate AG for carrying out an AND operation and comparator CP for comparing the sizes of the input signals input into two input terminals. Comparator CP compares voltage (Va+Vset2) obtained by superimposing voltage Vset2 to voltage Va with a drive waveform voltage. When the drive waveform voltage is higher than voltage (Va+Vset2), "0" is output, and in other cases, "1" is output. To AND gate AG, two input signals, that is, an output signal (CEL1) from computer CP and switching signal CEL2 are input. As switching signal CEL2, for example, a timing signal output from timing generating circuit 55 can be used. Then, AND gate AG outputs "1" when both input signals are "1," and in other cases, it outputs "0." The output from AND gate AG is input into control circuits IC1 to ICn. When the output of AND gate AG is "0", a drive waveform voltage is output via switching elements QL1 to QLn. When the output of AND gate AG is "1," voltage Vc obtained by superimposing voltage Vscn to voltage Vs is output via switching elements QH1 to QHn.

Although not shown, a sustain pulse generating circuit in sustain electrode driving circuit 54 has the same configuration as that of sustain pulse generating circuit 100; includes a power recovery circuit for recovering and reusing electric power at the time of driving sustain electrodes SU1 to SUn, a switching element for clamping sustain electrodes SU1 to SUn to voltage Vs, and a switching element for clamping sustain electrodes SU1 to SUn to 0 (V); and generates sustain pulse voltage Vs.

Note here that this exemplary embodiment employs a Miller integrating circuit using FET that is practical as initialization waveform generating circuit 300 and has a relatively simple configuration. However, the configuration is not necessarily limited to this, and any circuits may be used as long as they can generate a rising ramp waveform voltage and a descending ramp waveform voltage.

Next, an operation of initialization waveform generating circuit 300 and a method for controlling initialization voltage Vi4 are described with reference to drawings. Firstly, with reference to FIG. 11, an operation of setting initialization voltage Vi4 to Vi4L is described. Next, with reference to FIG. 12, an operation of setting initialization voltage Vi4 to Vi4H is described. Note here that in FIGS. 11 and 12, a method for controlling initialization voltage Vi4 is described with taking a drive waveform in the all-cell initialization operation as an example. However, also in the selective initialization operation, initialization voltage Vi4 can be controlled by the same control method.

Figure 11:
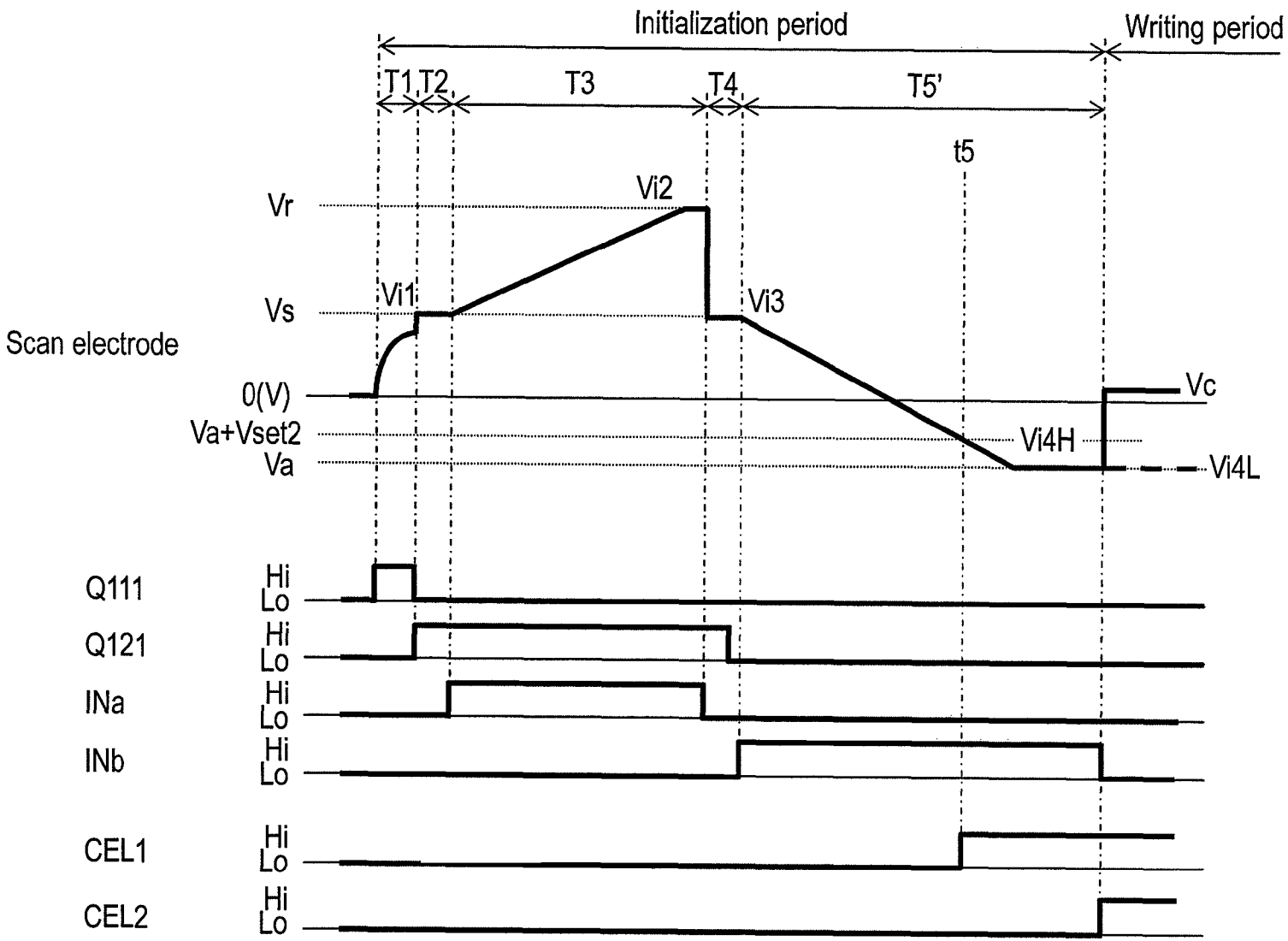
FIG. 11 is a timing chart to illustrate one example of an operation of the scan electrode driving circuit in an all-cell initialization period in accordance with an exemplary embodiment of the present invention.
Figure 12:
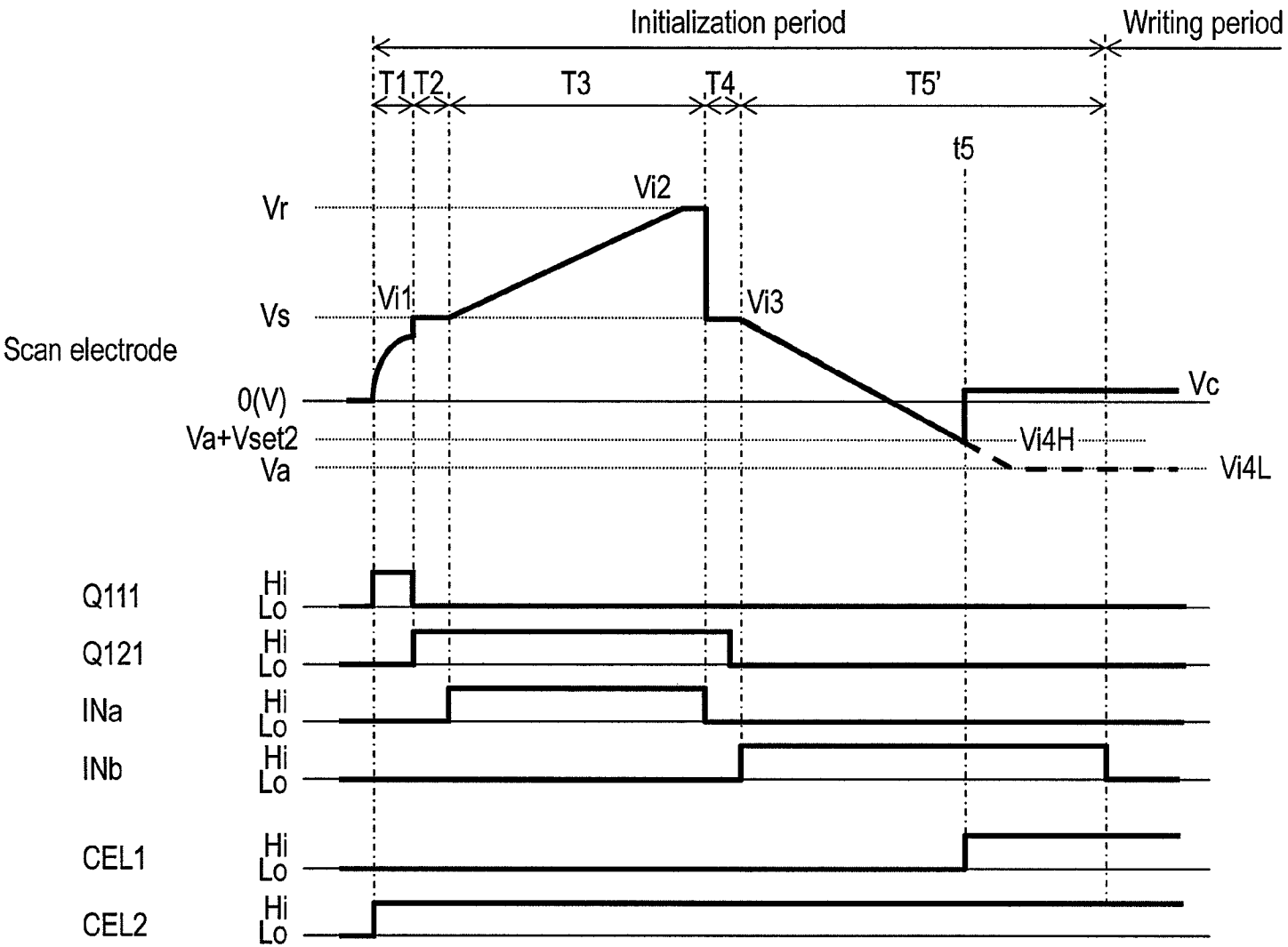
FIG. 12 is a timing chart to illustrate another example of an operation of the scan electrode driving circuit in an all-cell initialization period in accordance with an exemplary embodiment of the present invention.

Furthermore, in FIGS. 11 and 12, the drive voltage waveform for carrying out the all-cell initialization operation is divided into five terms, that is, term T1 to term T5. Each term is described. Herein, voltage Vi1, voltage Vi3 and voltage Vi3' are equal to voltage Vs; voltage Vi2 is equal to voltage Vr; voltage Vi4L is equal to negative voltage Va; and voltage Vi4H is equal to voltage (Va+Vset2), that is, a voltage obtained by superimposing voltage Vset2 to negative voltage Va. Therefore, voltage Vi4H is a voltage value that is higher than scan pulse voltage Va in the writing period, and voltage Vi4LH is a voltage value that is equal to scan pulse voltage Va. Furthermore, in the below mentioned description, an operation for making the switching element be conductive is denoted by ON and an operation for blocking is denoted by OFF. Furthermore, in the drawing, a signal for turning the switching element ON is shown by "Hi" and a signal for turning the switching element OFF is shown by "Lo." As to CEL1 and CEL2 that are input signals to AND gate AG, similarly, "1" is denoted by "Hi" and "0" is denoted by "Lo."

FIG. 11 is a timing chart to illustrate one example of an operation of scan electrode driving circuit 53 in the all-cell initialization period in accordance with the exemplary embodiment of the present invention. Herein, for setting initialization voltage Vi4 to Vi4Lt, switching signal CEL2 is maintained at "0" during terms T1 to T5. From scan pulse generating circuit 400, a signal to be input into switching elements QL1 to QLn, that is, a voltage waveform of initialization waveform generating circuit 300 is output as it is.

(Term T1)

Firstly, switching element Q111 of sustain pulse generating circuit 100 is turned on. Then, capacity Cp between electrodes resonates with inductor L100, and voltage of scan electrodes SC1 to SCn starts to rise from capacitor C100 for recovering electric power, through switching element Q111, diode D101, inductor L100.

(Term T2)

Next, switching element Q121 of sustain pulse generating circuit 100 is turned on. Then, voltage Vs is applied to scan electrodes SC1 to SCn via switching element Q121, and the potential of scan electrodes SC1 to SCn becomes voltage Vs (which is equal to voltage Vi1 in this exemplary embodiment).

(Term T3)

Next, input terminal INa of a Miller integrating circuit for generating a rising ramp waveform voltage is set to "Hi." Specifically, for example, voltage 15 (V) is applied to input terminal INa. Then, a constant current flows from resistor R310 toward capacitor C310, and a source voltage of switching element Q311 rises in a ramp form and an output voltage of scan electrode driving circuit 53 also rises in a ramp form. Then, this voltage rise is continued while input terminal INa is "Hi."

After this output voltage rises to voltage Vr (which is equal to voltage Vi2 in this exemplary embodiment), input terminal INa is made to "Lo." Specifically, for example, voltage 0 (V) is applied to input terminal INa.

Thus, a rising ramp waveform voltage gradually rising from voltage Vs (which is equal to voltage Vi1 in this exemplary embodiment) that is a discharge starting voltage or less toward voltage Vr (which is equal to voltage Vi2 in this exemplary embodiment) that is more than the discharge starting voltage is applied to scan electrodes SC1 to SCn.

(Term T4)

When input terminal INa is set to "Lo," the voltage of scan electrodes SC1 to SCn is reduced to voltage Vs (which is equal to voltage Vi3 in this exemplary embodiment). Thereafter, switching element Q121 is turned off.

(Term T5)

Next, input terminal INb of a Miller integrating circuit generating a descending ramp waveform voltage is set be "Hi." Specifically, for example, voltage 15 (V) is applied to input terminal INb. Then, a constant current flows from resistor R320 toward capacitor C320, a drain voltage of switching element Q322 descends in a ramp form and an output voltage of scan electrode driving circuit 53 also starts to descend in a ramp form. Then, after the output voltage reaches a predetermined negative voltage Vi4L, input terminal INb is set to "Lo." Specifically, for example, voltage 0 (V) is applied to input terminal INb.

At this time, comparator CP compares this descending ramp waveform voltage with voltage (Va+Vset2) obtained by adding voltage Vset2 to voltage Va. The output signal from comparator CP is switched from "0" to "1" at time t4 when the descending ramp waveform voltage becomes voltage (Va+Vset2) or less. However, in term T1 to term T5, since switching signal CEL2 is maintained at "0," "0" is output from AND gate AG. Therefore, scan pulse generating circuit 400 outputs a descending ramp waveform voltage as it is in which initialization voltage Vi4 is set to negative voltage Va, that is, Vi4L.

Herein, since Vi4L is made to be equal to negative voltage Va, FIG. 11 shows a waveform showing that the voltage is maintained for a predetermined time after the descending ramp waveform voltage reaches Vi4L. However, in this exemplary embodiment, the waveform is not necessarily limited to this configuration, and the voltage may be switched to voltage Vc immediately after the descending ramp waveform voltage reaches Vi4L.

As mentioned above, to scan electrodes SC1 to SCn, scan electrode driving circuit 53 applies a rising ramp waveform voltage gradually rising from voltage Vi1 that is a discharge starting voltage or less toward voltage Vi2 that exceeds the discharge starting voltage, and then, scan electrode driving circuit 53 applies a descending ramp waveform voltage gradually descending from voltage Vi3 to initialization voltage Vi4L.

Note here that, in the subsequent writing period after the initialization period is completed, switching element Q401 is maintained to be ON. Thus, output signal CEL1 from comparator CP is maintained at "1." Furthermore, in the writing period, switching signal CEL2 is set to "1." Then, both inputs of AND gate AG become "1," and "1" is output from AND gate AG. Thus, from scan pulse generating circuit 400, voltage Vc obtained by superimposing voltage Vscn to negative voltage Va is output. Then, although not shown, when switching signal CEL2 is set to "0" at a timing at which a negative scan pulse voltage is generated, the output signal of AND gate AG becomes "0" and negative voltage Va is output from scan pulse generating circuit 400. In this way, it is possible to generate a negative scan pulse voltage in the writing period.

Next, with reference to FIG. 12, an operation for setting initialization voltage Vi4 to Vi4H is described. FIG. 12 is a timing chart to illustrate another example of an operation of scan electrode driving circuit 53 in the all-cell initialization period in accordance with the exemplary embodiment of the present invention. Herein, in order to make initialization voltage Vi4 to Vi4H, between term T1 and term T5', switching signal CEL2 is set to "1." Furthermore, since an operation between term T1 and term T4 in FIG. 12 is the same as the operation between term T1 and term T4 shown in FIG. 11, an operation in term T5' that is different from the operation in term T5 shown in FIG. 11 is descried.

(Term T5')

In term T5', input terminal INb of a Miller integrating circuit generating a descending ramp waveform voltage is set to "Hi." Specifically, for example, voltage 15 (V) is applied to input terminal INb. Then, a constant current flows from resistor R320 toward capacitor C320, a drain voltage of switching element Q322 descends in a ramp form and an output voltage of scan electrode driving circuit 53 also starts to descend in a ramp form.

At this time, comparator CP compares this descending ramp waveform voltage with voltage (Va+Vset2) obtained by adding voltage Vset2 to voltage Va. The output signal from comparator CP is switched from "0" to "1" at time t5 when the descending ramp waveform voltage becomes voltage (Va+Vset2) or less. At this time, since switching signal CEL2 is "1," the input of AND gate AG is "1," and "1" is output from AND gate AG. Thereby, voltage Vc obtained by superimposing voltage Vscn to voltage Va is output from scan pulse generating circuit 400. Therefore, the minimum voltage in this descending ramp waveform voltage can be made to (Va+Vset2), that is, Vi4H. Input terminal INb is set to "Lo" during the time between when the output from scan pulse generating circuit 400 becomes voltage Vc and when the initialization period is completed.

Note here that in this configuration, since switching circuits OUT1 to OUTn are switched based on the comparison results in comparator CP, FIG. 12 shows a waveform in which the voltage is switched to voltage Vc immediately after the descending ramp waveform voltage reaches Vi4H. However, in this exemplary embodiment, the waveform is not necessarily limited to this configuration. The waveform may have a configuration in which after descending ramp waveform voltage reaches Vi4H, the voltage is maintained for a predetermined time.

Thus, in this exemplary embodiment, when scan electrode driving circuit 53 is configured as shown in FIG. 10, by only setting voltage Vset2 to a predetermined voltage value, the minimum voltage of the gradually descending ramp waveform voltage, that is, the voltage value of initialization voltage Vi4 may be controlled in a simple manner.

This exemplary embodiment describes controlling of initialization voltage Vi4 in the all-cell initialization operation. However, the selective initialization operation can be carried out by the same operation as mentioned above except that a rising ramp waveform voltage is not generated. Therefore, controlling of initialization voltage Vi4 can be similarly carried out.

A method for changing initialization voltage Vi4 may include various methods other than the method described herein. For example, a method for increasing or reducing voltage Vi4 by controlling the inclination of the tilt descending from voltage Vi3 to voltage Vi4 may be employed. Then, in this exemplary embodiment, a method for changing initialization voltage Vi4 is not necessarily limited to the above-mentioned method, and other methods may be employed.

In this exemplary embodiment, Vi4H is set to higher than Vi4L by 10 (V) by setting Vset2 to 10 (V). However, the voltage value is not necessarily limited to this value. It is desirable that the voltage value is set to an optimum value in accordance with the property of the panel and specification of the plasma display device.

As mentioned above, this exemplary embodiment has a configuration in which initialization voltage Vi4 is switched between Vi4H and Vi4L that is lower voltage value than Vi4H. This configuration changes the ratio in one field period of a subfield in which an initialization is carried out by a descending ramp waveform voltage whose initialization voltage Vi4 is Vi4L depending upon a panel temperature. That is to say, when panel temperature determination circuit 58 determines that the panel temperature is low, initialization voltage Vi4 of the descending ramp waveform voltage in all the subfields is set to Vi4L. Thus, a charge decrease that tends to generate at low temperatures is prevented, and a stable writing is realized.

In this exemplary embodiment, when panel temperature determination circuit 58 determines that a panel temperature is not low, initialization voltage Vi4 of the descending ramp waveform voltage is set to Vi4H in all subfields and when it determines that a panel temperature is low, initialization voltage Vi4 of the descending ramp waveform voltage is set to Vi4L in all subfields. However, the configuration is not necessarily limited to this, and other subfield configurations may be employed.

Figure 13A:
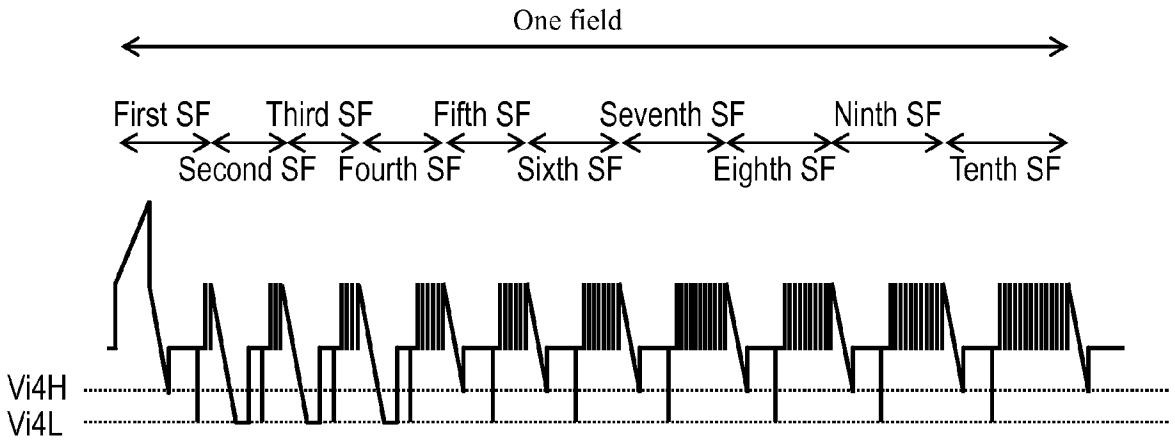
FIG. 13A is view showing another example of a subfield configuration in accordance with the exemplary embodiment of the present invention.
Figure 13B:
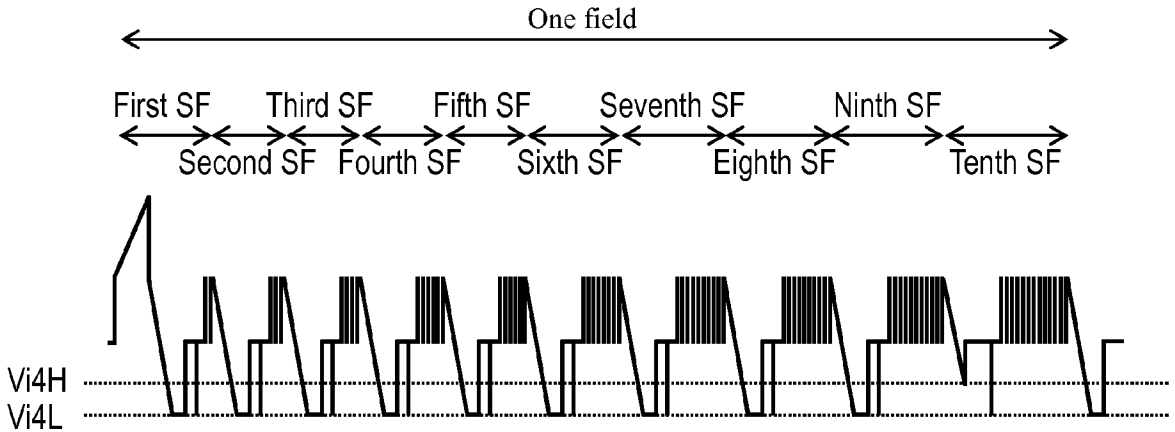
FIG. 13B is view showing a further example of a subfield configuration in accordance with the exemplary embodiment of the present invention.

FIGS. 13A and 13B are views showing another example of a subfield configuration in accordance with the exemplary embodiment of the present invention. When the panel temperature is not low, predetermined subfields, for example, the second SF to the fourth SF as shown in FIG. 13A are made to be a subfield in which an initialization is carried out by a descending ramp waveform voltage whose initialization voltage Vi4 is Vi4L. The other subfields may be a subfield in which an initialization is carried out by a descending ramp waveform voltage whose initialization voltage Vi4 is Vi4H.

Furthermore, when the panel temperature is low, a predetermined subfield, for example, the tenth SF as shown in FIG. 13B is made to be a subfield in which an initialization is carried out by a descending ramp waveform voltage whose initialization voltage Vi4 is Vi4H and other subfields may be a subfield in which an initialization is carried out by a descending ramp waveform voltage whose initialization voltage Vi4 is Vi4L.

Furthermore, the detection of the panel temperature is divided into three temperatures, that is, low temperature, ordinary temperature and high temperature, or more temperatures. As the temperature becomes lower, the number of subfields in which an initialization is carried out by a descending ramp waveform voltage whose initialization voltage Vi4 is Vi4L may be increased.

Thus, this exemplary embodiment may have a configuration of increasing the ratio in one field period of a subfield in which an initialization is carried out by a descending ramp waveform voltage whose initialization voltage Vi4 is Vi4L when the panel temperature is low. Thus, it is possible to realize a stable writing.

Note here that in this exemplary embodiment, the subfield in which a voltage value of Vi4L, a voltage value of Vi4H, and initialization voltage Vi4 are switched and the configuration of the subfield and the like are not necessarily limited to the above-mentioned values. It is desirable that a voltage value may be set to an optimum value in accordance with the panel characteristics and the specification of the plasma display device and the like.

Furthermore, if the hysteresis property is provided in the determination of the panel temperature, when the panel temperature detected in the panel temperature determination circuit is around the threshold value, frequent change of initialization voltage Vi4 can be suppressed and the image display quality can be further improved. Specifically, by providing two low-temperature threshold values and setting a low-temperature threshold value (for example, 7° C.) in which a state of low temperature is switched to a state of not low temperature to be higher than the low-temperature threshold value (for example, 5° C.) in which a state of not-low temperature is switched to a state of low temperature, it is possible to provide a hysteresis property.

In this exemplary embodiment, a xenon partial pressure in a discharge gas is set to 10%. Other xenon partial pressure may be employed as long as it is a driving voltage corresponding to the panel.

Furthermore, each numeric value specifically used in this exemplary embodiment is described as just an example and it is desirable to set to an optimum value appropriately in accordance with the property of the panel and specification of a plasma display device, and the like.

As mentioned above, in this exemplary embodiment, when the temperature of panel 10 is determined to be low by a panel temperature determination circuit, initialization voltage Vi4 is set to Vi4L that is lower voltage value than Vi4H. Thus, writing pulse voltage Vd necessary to generate a stable writing discharge can be reduced and writing pulse voltage Vd actually applied to data electrodes D1 to Dm can be relatively increased with respect to writing pulse voltage Vd necessary for stable writing, thus enabling a stable writing. Furthermore, when initialization voltage Vi4 is set to Vi4L, the descending ramp waveform voltage is made to be deep waveform and the discharge time of the initialization discharge can be increased. Therefore, a function of weakening the wall voltage on data electrodes D1 to Dm is increased so as to lower the wall voltage. Thus, by reducing the deprivation of the wall charge in the discharge cell in a row that is not selected and charge decrease that tends to occur at low temperatures can be prevented.

Industrial Applicability

The present invention is useful for a plasma display panel with high image display quality and a method for driving a panel. In the present invention, even in a panel having a high brightness and a high definition, it is possible to generate a stable writing discharge without raising a voltage necessary to generate a writing discharge.

The invention claimed is:

1. A plasma display device comprising:

a plasma display panel including a plurality of discharge cells, each of the plurality of discharge cells including a display electrode pair having a scan electrode and a sustain electrode;

a panel temperature determination circuit for determining a state of a temperature of the plasma display panel; and a scan electrode driving circuit (i) forming one field period to have a plurality of subfields, each of the plurality of subfields including an initialization period in which a descending sloping waveform voltage is applied to the scan electrode, a writing period in which a negative scan pulse voltage is applied to the scan electrode, and a sustain period, (ii) generating the descending sloping waveform voltage in the initialization period so as to initialize the plurality of discharge cells, and (iii) generating the negative scan pulse voltage in the writing period so as to drive the scan electrode, wherein the scan electrode driving circuit generates the descending sloping waveform voltage, such that in the initialization period a minimum voltage of the descending sloping waveform voltage is switched between two kinds of voltages including a first voltage and a second voltage having a lower voltage value than the first voltage, and wherein, when the panel temperature determination circuit determines that the state of the temperature is low as compared with when the panel temperature determination circuit determines that the state of the temperature is not low, the scan electrode driving circuit decreases, in the one field period, a number of subfields, of the plurality of subfields, in which an initialization is carried out in the initialization period by the descending sloping waveform voltage having the minimum voltage as the first voltage, the scan electrode driving circuit increases, in the one field period, a number of subfields, of the plurality of subfields, in which an initialization is carried out in the initialization period by the descending sloping waveform voltage having the minimum voltage as the second voltage, and both (i) the subfield, of the plurality of subfields, in which an initialization is carried out in the initialization period by the descending sloping waveform voltage having the minimum voltage as the first voltage, and (ii) the subfield, of the plurality of subfields, in which an initialization is carried out in the initialization period by the descending sloping waveform voltage having the minimum voltage as the second voltage, exist in a same field period.

2. The plasma display device of claim 1, wherein the scan electrode driving circuit generates the descending sloping waveform voltage having the minimum voltage as the second voltage in the initialization period of each subfield of the plurality of subfields, when the panel temperature determination circuit determines that the state of the temperature of the plasma display panel is low, and wherein the second voltage is equal to the negative scan pulse voltage.

3. The plasma display device of claim 1, wherein the scan electrode driving circuit generates the descending sloping waveform voltage, such that the second voltage is equal to the negative scan pulse voltage, and wherein the first voltage is higher than the second voltage by not less than 5 volts.

4. A method for driving a plasma display panel including a plurality of discharge cells, each of the plurality of discharge cells including a display electrode pair having a scan electrode and a sustain electrode, by providing one field period with a plurality of subfields, each of the plurality of subfields having an initialization period in which a descending sloping waveform voltage is applied to the scan electrode, a writing period in which a negative scan pulse voltage is applied to the scan electrode and a sustain period, the method comprising:

generating the descending sloping waveform voltage, such that in the initialization period a minimum voltage of the descending sloping waveform voltage is switched between two kinds of voltages including a first voltage and a second voltage having a lower voltage value than the first voltage;

determining a state of a temperature of the plasma display panel;

decreasing, in the one field period, a number of subfields, of the plurality of subfields, in which an initialization is carried out in the initialization period by the descending sloping waveform voltage having the minimum voltage as the first voltage, when the determining determines that the state of the temperature is low as compared with when the determining determines that the state of the temperature is not low; and increasing, in the one field period, a number of subfields, of the plurality of subfields, in which an initialization is carried out in the initialization period by the descending sloping waveform voltage having the minimum voltage as the second voltage, when the determining determines that the state of the temperature is low as compared with when the determining determines that the state of the temperature is not low, wherein, both (i) the subfield, of the plurality of subfields, in which an initialization is carried out in the initialization period by the descending sloping waveform voltage having the minimum voltage as the first voltage, and (ii) the subfield, of the plurality of subfields, in which an initialization is carried out in the initialization period by the descending sloping waveform voltage having the minimum voltage as the second voltage, exist in a same field period.

5. The method for driving the plasma display panel of claim 4, wherein the descending sloping waveform voltage having the minimum voltage as the second voltage is generated in the initialization period of each subfield of the plurality of subfields, when the state of the temperature of the plasma display panel is determined to be low, and wherein the second voltage is equal to the negative scan pulse voltage.

6. The method for driving the plasma display panel of claim 4, wherein the second voltage is equal to the negative scan pulse voltage, and wherein the first voltage is higher than the second voltage by not less than 5 volts.

* * * * *